United States Patent [19]

Toma et al.

[11] Patent Number: 4,837,891

[45] Date of Patent: Jun. 13, 1989

[54] TRACK AND TROLLEY WITH DUAL DRIVE WHEELS HAVING ANNULAR TRACK ENGAGING SURFACES OF DIFFERENT DIAMETERS

[75] Inventors: John W. Toma, Louisville, Ky.; N. Douglas Owens, Lynn, Ind.

[73] Assignee: Modernfold, Inc., New Castle, Ind.

[21] Appl. No.: 60,477

[22] Filed: Jun. 11, 1987

[51] Int. Cl.[4] ..... E05D 15/06

[52] U.S. Cl. ..... 16/87.4 R; 16/89; 16/91; 16/95 R; 16/102; 16/106; 104/94; 104/111

[58] Field of Search ..... 16/89, 91, 102, 106, 16/87.4 R, 87.4 W, 95 R, 95 D, 95 W, 95 DW; 104/89, 94, 106, 107, 108, 109, 140; 105/148, 150, 155; 211/122

[56] References Cited

U.S. PATENT DOCUMENTS

| | | | |
|---|---|---|---|
| 1,921,314 | 8/1933 | Garrison | 16/91 |
| 2,444,432 | 7/1948 | Eckert | 16/91 |
| 3,042,960 | 7/1962 | Spork | 16/89 |
| 3,287,759 | 11/1966 | Foltz . | |
| 3,879,799 | 4/1975 | Williams . | |
| 4,302,865 | 12/1981 | Dixon et al. | 16/95 R |
| 4,401,033 | 8/1983 | Gerken | 104/94 |

FOREIGN PATENT DOCUMENTS

| | | | |
|---|---|---|---|
| 1189888 | 3/1965 | Fed. Rep. of Germany | 16/106 |

*Primary Examiner*—Nicholas P. Godici
*Assistant Examiner*—Edward A. Brown
*Attorney, Agent, or Firm*—Baker & Daniels

[57] ABSTRACT

A track and trolley system that allows wall panels to be moved with a minimum amount of friction is disclosed. The system includes a track having a first rail, a second rail which is higher than the first rail, and a trolley having two drive wheels that engage the rails via annular track engaging surfaces of different diameters. Each drive wheel is independently rotatable in opposite directions. The system further includes a wall panel mount assembly haivng a housing integral with a movable wall panel and slide pads at track intersections to reduce the vertical elevational drop of a trolley when it moves across a track intersection.

49 Claims, 14 Drawing Sheets

TRACK AND TROLLEY WITH DUAL DRIVE WHEELS HAVING ANNULAR TRACK ENGAGING SURFACES OF DIFFERENT DIAMETERS

FIELD OF THE INVENTION

This invention relates to track suspension systems for supporting movable wall panels, such as those used to partition large rooms into smaller rooms.

BACKGROUND

Four objectives of trolley and track systems that suspend movable wall panels are: (1) to allow the walls to be moved with as little friction as possible; (2) to keep the wall panels properly centered within the track; (3) to reduce the shock caused by a trolley impacting a stationary object such as a track intersection and to allow panels to sway; and (4) to allow the panels to be moved across angular (as opposed to curved) track intersections without the trolleys dropping into gaps which usually exist in such intersections. No known system accomplishes all of these objectives.

Single puck or disc trolleys such as disclosed in U.S. Pat. No. 4,084,289 generally fail to reduce friction to an acceptable level because one side of the trolley rotates in a direction opposite to the direction the wall is moved. This problem was solved in U.S. Pat. No. 4,141,106 by using a canted puck, but such a system allows a panel to sway to an unacceptable level, and does not keep the wall panel properly centered in its track.

Another method is to use a track having a pair of flanges, which engage two vertically spaced trolleys or pucks. In U.S. Pat. No. 4,159,556, the objective of such a system was to allow the trolley to easily traverse track intersections. However, such systems require twice as much contact between the trolley and track, increasing friction. Other systems, such as those described in U.S. Pat. Nos. 3,042,960, 3,879,799 and 4,401,033, provide for upper and lower discs, with only opposite sides of the upper and lower discs engaging the track. However, such systems are not only expensive to manufacture, but do not allow a standard wheeled trolley to be used in the track if desired. Other known systems do not adequately protect the joint of a trolley and wall panel, causing such joints to quickly wear from the shock resulting when a trolley is moved in a track intersection or when a panel sways. In addition, wall panels become stuck in track intersections in other known systems because the trolleys are prone to drop into the gaps in such intersections.

SUMMARY OF THE INVENTION

The invention comprises a track and trolley system that allows wall panels to be moved with a minimum amount of friction. The system includes a track having a first rail which may be horizontal, a longitudinally parallel second rail which is higher than the first rail, and a trolley having two drive wheels that engage the rails via annular track engaging surfaces of different diameters. Alternatively, the slanted rail of the track may include a short horizontal surface, to allow the track to be used with standard wheeled trolleys in addition to horizontal drive trolleys.

The trolley utilizes a vertical shaft having an outer drive wheel having an annular track engaging surface which is rotatably mounted on the shaft. An inner drive wheel, also rotatably mounted on the shaft, has an annular track engaging surface with a smaller diameter than the diameter of the outer drive wheel's annular track engaging surface. The inner drive wheel may have either a horizontal lower surface or a substantially tapered lower surface, whereby its annular surface closest to the shaft is below its annular surface furthest from the shaft. If the lower surface of the inner drive wheel is tapered, it may be either concial or spherical. The inner drive wheel's annular track engaging surface is below the annular track engaging surface of the outer drive wheel. Each drive wheel may be independently rotatable in opposite directions. This eliminates the additional friction created by some prior art trolleys using a single rotatable bearing which engages both rails simultaneously.

A major advantage of the invention is that its inner and outer drive wheels contact their respective tracks via annular surfaces of different diameters. This is important because it allows a more compact construction and because it reduces the vertical elevational drop when a trolley is moved through a track intersection. As long as the radius of the outer drive wheel track engaging surface is greater than the diameter of the inner drive wheel track engaging surface, the outer drive wheel will engage a track across an intersection gap before the inner drive wheel begins to drop into the gap. This is a significant improvement over the prior art, in which the engaging surfaces of counter-rotating drive wheels typically have equal radii.

The system further includes a wall panel mount assembly having a housing integral with a movable wall panel. The housing has upper and lower walls, and an upper aperture capable of receiving a shaft to which a trolley is mounted. The housing encloses a nut into which the shaft may be screwed. The nut is surrounded by a resilient flexible block with washers located above and below the block. A second resilient flexible block of material is below the lower washer, and includes a cavity capable of receiving the shaft.

The system also includes slide pads at track intersections to reduce the vertical elevational drop of a trolley when it moves across an intersection. An intersection may be an X, T, L or Y intersection. When a trolley is positioned in a track, there are vertical spaces between each drive wheel and the track. The slide pads occupy these spaces in a track intersection to keep the trolley at substantially same elevation and to prevent the trolley from dropping. The slide pads may be mounted to support just the outer drive wheel, or both inner and outer drive wheels. Also in the preferred embodiment, the outer drive wheel has a substantially horizontal lower surface to increase the contact area between the wheel and the slide pads in an intersection to provide additional support of the trolley.

DESCRIPTION OF THE PREFERRED EMBODIMENT

Figure 1:
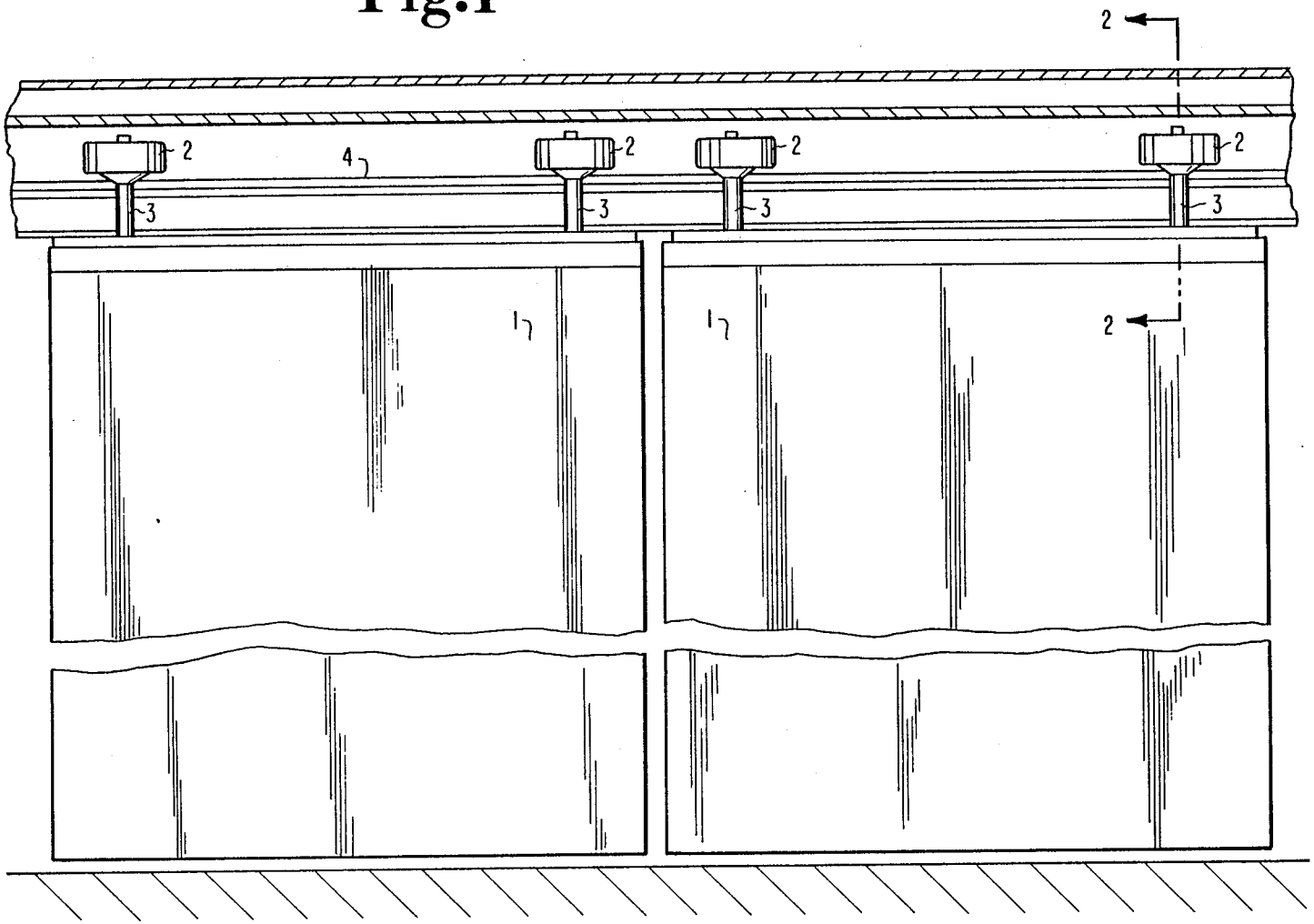
FIG. 1 is a vertical section of a movable wall panel system with which the invention may be used.

FIG. 1 is a vertical section of a movable wall panel system with which the invention may be used. Movable panels 1 are suspended from trolleys 2 by pendant bolts 3. The trolleys 2 travel in track 4. One problem with prior systems is that when trolleys 2 are moved against stationary objects such as track intersections, trolleys 2 are subject to shock, thus causing them to wear. The present invention solves this problem as described below by connecting trolleys 2 to panels 1 using flexible mountings.

Figure 2:
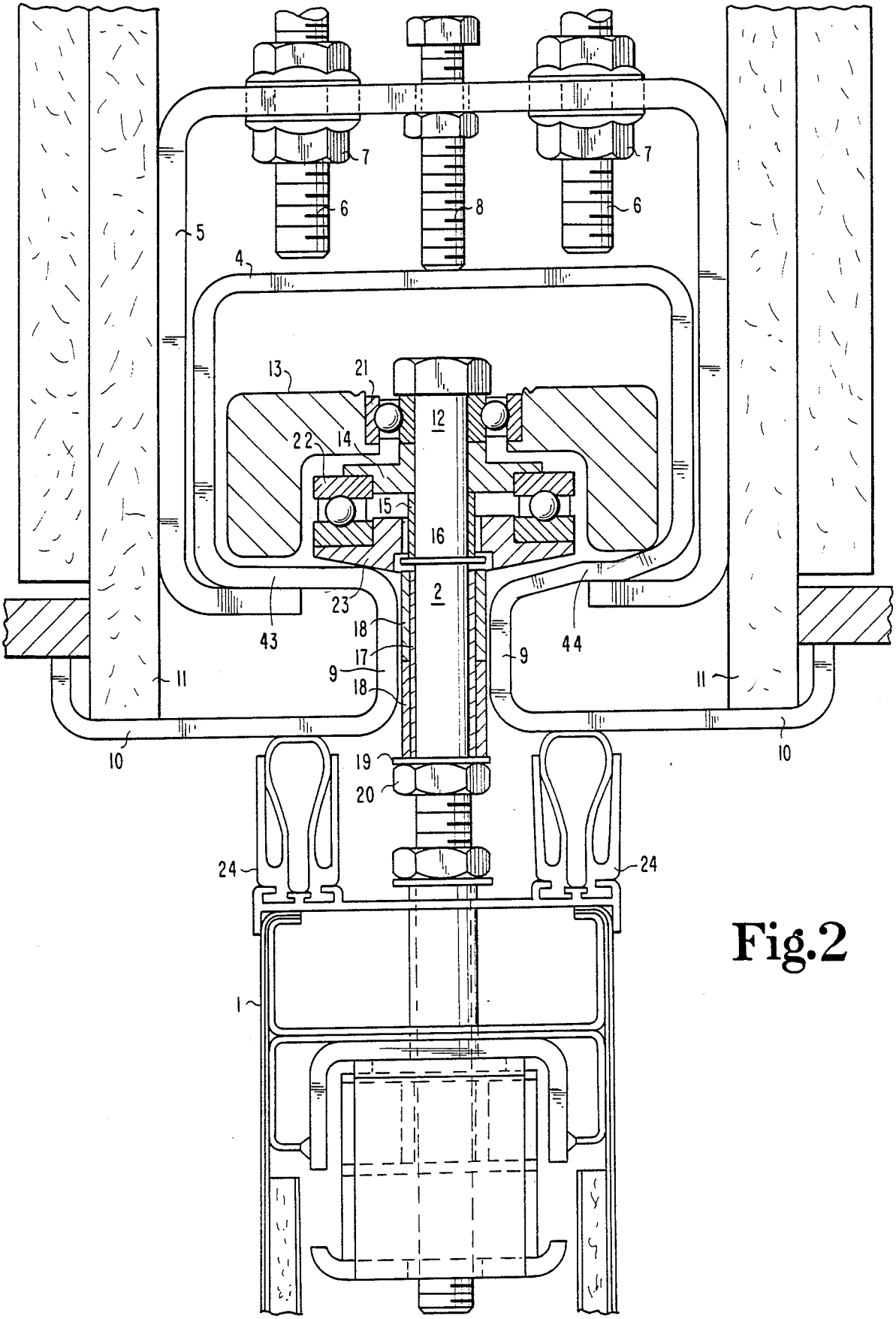
FIG. 2 is a vertical section of the track and trolley system of the invention taken in the line of 2—2 of FIG. 1.

FIG. 2 is a vertical section of the track and trolley system of the invention taken in the line of 2-2 of FIG. 1. The bottom surfaces of first rail 43 and second rail 44 are substantially coplanar so that track 4 may be held by C channel 5, which is attached to overhead structure by supporting bolts 6 and nuts 7. Height alignment bolt 8 abuts the top of track channel 5 so height of track channel 5 may be controlled. Guide walls 9 extend from track 4 to provide proper alignment of the trolley 2. Flanges 10 outwardly extend from guide walls 9 to serve as a soffit and to receive wallboards 11 which act as sound baffles.

The trolley includes bolt 12, which serves as a shaft to support outer drive wheel bearing 21, bottom spacer 14, upper spacer tube 15, washer 16, lower spacer tube 17, sleeve bearings 18, lock washer 19 and jam nut 20. Sleeve bearings 18 should be freely rotatable, so their combined length should be greater than that of lower spacer tube 17. Outer drive wheel bearing 21 supports outer drive wheel 13, while bottom spacer 14 supports inner drive wheel bearing 22 which in turn supports inner drive wheel 23. Thus, outer drive wheel 13 and inner drive wheel 23 may independently rotate in opposite directions.

The lower portion of bolt 12 is attached to movable wall panel 1. Movable wall panel 1 includes seals 24, which act as a sound seal and which help protect the trolley assembly from exposure to dirt and the like.

It may be appreciated that the present invention allows a wall panel to hang plumb, keeping the trolley engaged on both sides of the track.

Figure 3:
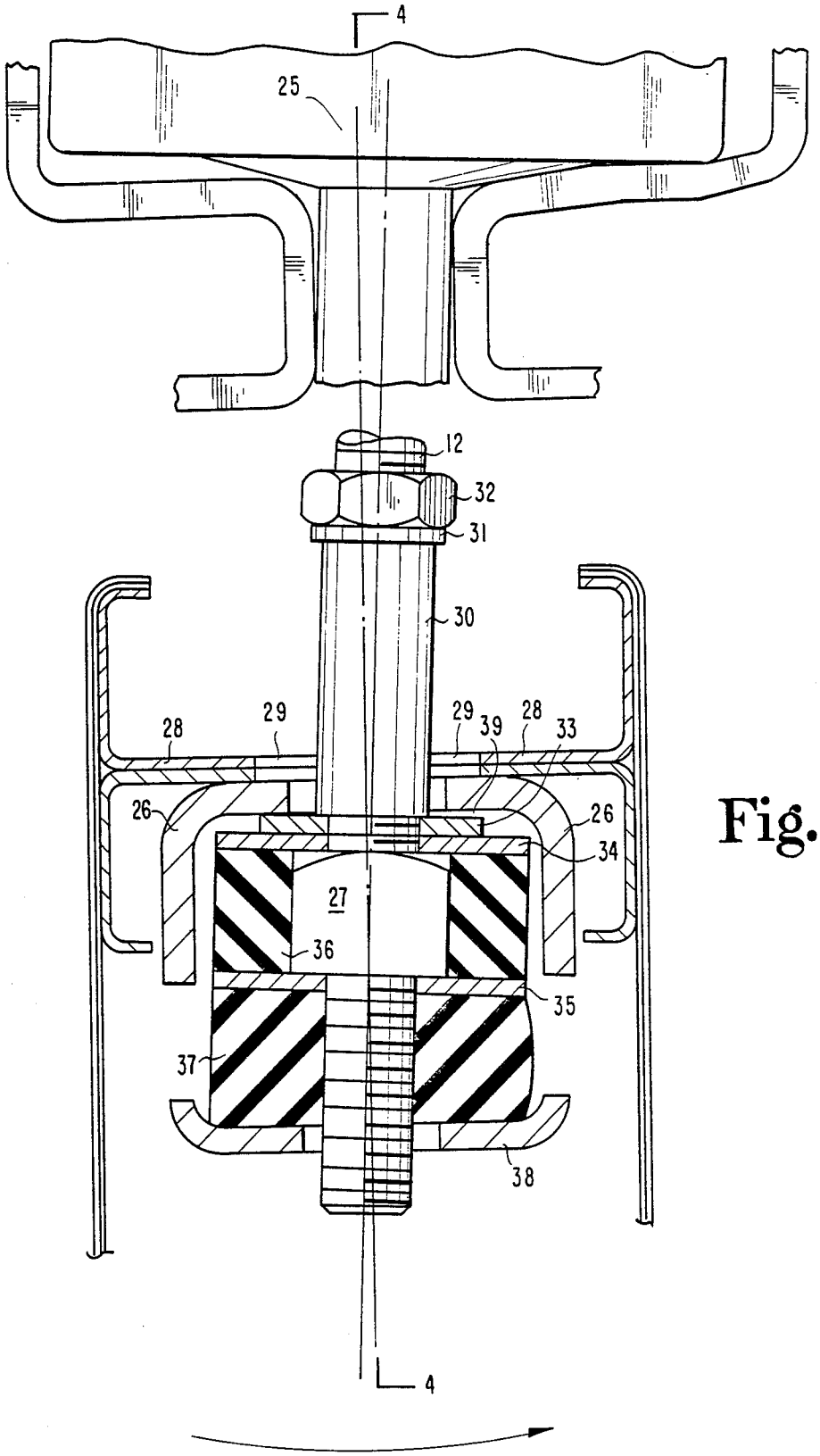
FIG. 3 is a vertical section of the flexible wall panel mount assembly of the invention, showing how swaying of a panel is absorbed by the mount.

FIG. 3 is a vertical section of the flexible wall panel mount assembly of the invention, showing how the mount allows swaying of a panel. Bolt 12 extends from trolley assembly 25 and is secured to upper wall mount housing 26 by square nut 27. Upper wall panel frame 28 includes aperture 29 through which bolt 12 extends. Bolt 12 has mounted thereon spacer tube 30, which is secured by washer 31 and lock nut 32. Distal adjustment of the wall panel with respect to trolley assembly 25 is made by adjusting the extent to which bolt 12 is screwed into square nut 27. The distance between the trolley assembly 25 and movable wall panel 1 should be the same for all such assemblies and panels. Once the desired distance is obtained, lock nut 32 is tightened against washer 31 and spacer tube 30 to prevent bolt 12 from rotating with respect to square nut 27. Aperture 29 has a diameter greater than spacer tube 30, so spacer tube 30 can move without hitting the edges of aperture 29. Spacer tube 30 abuts top washer 33, which is positioned below upper wall mount housing 26 and above washer 34. In between washer 34 and center washer 35 is nut retainer 36. Nut retainer 36 is a rectangular block of resilient flexible material such as rubber with a square hole in the center which holds square nut 27 and acts as a shock absorber. Beneath center washer 35 is trolley mount retainer 37, which is a square block of resilient flexible material such as rubber with a hole through the center for receiving bolt 12. Trolley mount retainer 37 acts as a compression spring and shock absorber, and is held in place by lower wall mount housing 38. As shown more fully in FIG. 4, lower wall mount housing 38 is fastened to upper wall mount housing 26 by means such as welding, and supports trolley mount retainer 37.

The shock absorbing characteristics of the flexible wall panel mount assembly are demonstrated in FIG. 3. when a movable wall panel is swayed out of a plumb position, top washer 33 pivots on its leading edge, causing a gap 39 between top washer 33 and upper wall mount housing 26. Nut retainer 36 partially absorbs the shock, and together with square nut 27, apply force on center washer 35, which in turn, together with bolt 12, compress trolley mount retainer 37 and absorb the remainder of the shock. Trolley mount retainer 37 acts like a compression spring and a shock absorber, and becomes increasingly stiff as deformation is increased. After displacement, nut retainer 36 and trolley mount retainer 37 return to their normal position. The stiffness of the mount may be changed by varying the durometer hardness of nut retainer 36 and trolley mount retainer 37.

Figure 4:
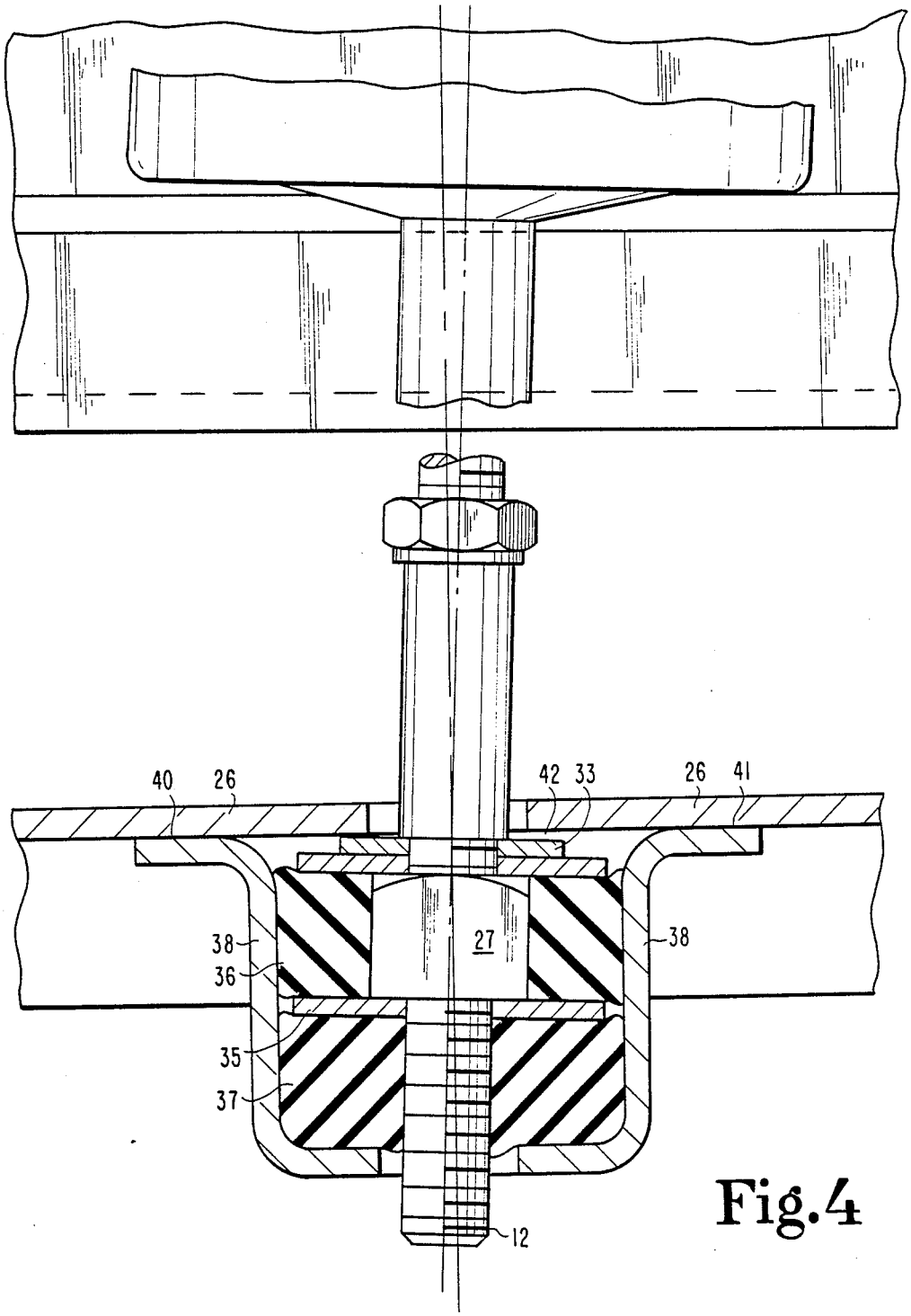
FIG. 4 is a vertical section of the flexible wall panel mount assembly of the invention showing how the mount absorbs shock resulting from moving the trolley against a stationary object.

FIG. 4 is a vertical section of the flexible wall panel mount assembly of the invention taken from an angle perpendicular to that of FIG. 3, showing how the mount absorbs shock resulting from moving the trolley against a stationary object such as a track intersection. From the view of FIG. 4, it may be appreciated that lower wall mount housing 38 may be spot welded to upper wall mount housing 26 at weld points 40 and 41. Upon impact, top washer 33 pivots, causing a gap 42 between top washer 33 and upper wall mount housing 26. Nut retainer 36 partially absorbs the shock, and together with square nut 27, apply force on center washer 35, which in turn, together with bolt 12, compress trolley mount retainer 37 to absorb the remainder of the shock.

Figure 5:
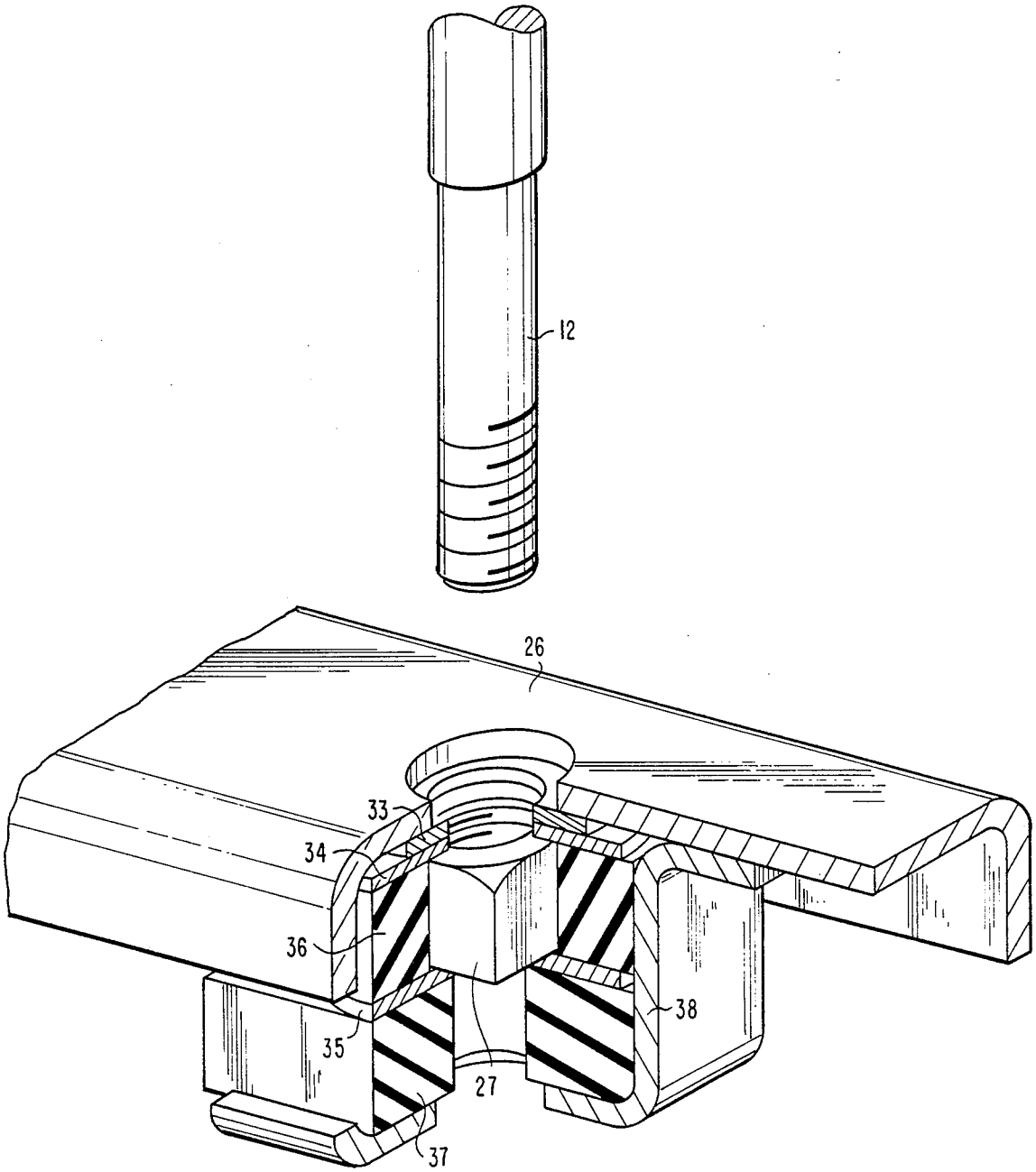
FIG. 5 is a perspective section of the flexible wall panel mount assembly.

FIG. 5 is a perspective section of the flexible wall panel mount assembly. From this view, it may be seen that upper wall mount housing 26 and lower wall mount housing 38 have mounted therein top washer 33, washer 34, nut retainer 36, square nut 27, center washer 35, and trolley mount retainer 37. Bolt 12, which extends from the trolley, may be screwed into square nut 27, effecting the distance between the wall panel and trolley assembly.

Figure 6:
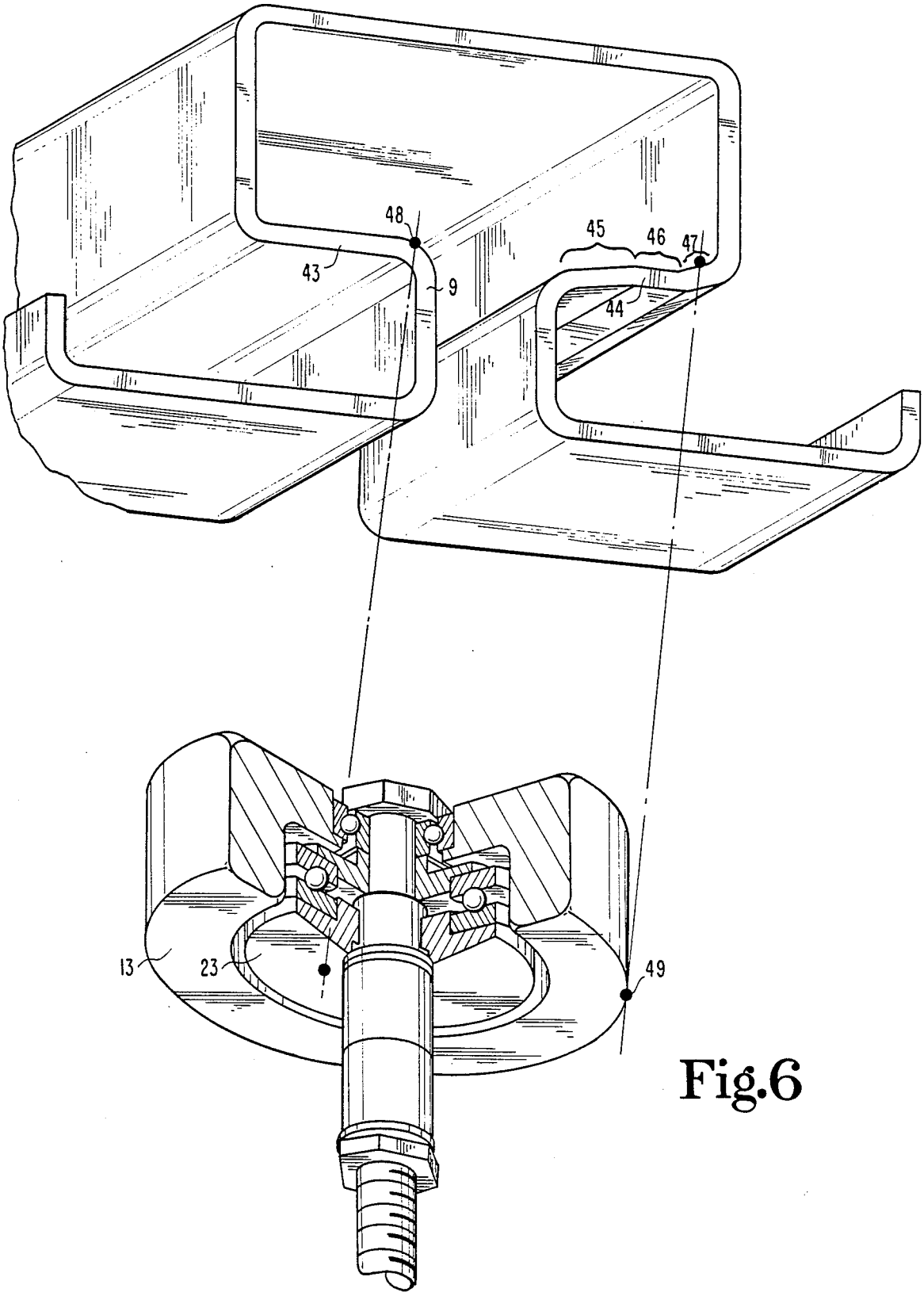
FIG. 6 is a perspective section of the trolley and track, showing the points at which the inner and outer drive wheels of the trolley engage the track.

FIG. 6 is a perspective section of the trolley and track, showing the points at which the inner and outer drive wheels of the trolley engage the track. Although left rail 43 and right rail 44 may appear coplanar at first glance, closer examination reveals that right rail 44 is actually comprised of three separate longitudinal planar surfaces, 45, 46, and 47. As the lower surface of inner drive wheel 23 extends below the planar surface of outer drive wheel 13, inner drive wheel 23 engages left rail 43 along its annular edge 48 with guide wall 9. However, planar surface 45 of right rail 44 is below the planar surface of left rail 43, so that the lower surface of outer drive wheel 13 does not engage either of these surfaces or longitudinal planar surface 46. Instead, the outer annular edge 49 of outer drive wheel 13 engages right rail 44 along longitudinal planar surface 47, which is adjacent to surface 46 and which upwardly extends from the plane defined by the surface of left rail 43. Right rail 44 need not necessarily extend towards the trolley as shown in FIG. 6, so right rail 44 need not include planar surface 45 or 46. It is sufficient to practice the present invention if right rail includes only a planar surface for engagement of outer drive wheel 13 which does not engage inner drive wheel 23. The engaging surface of inner drive wheel 23 has a radius as opposed to a conical surface. This reduces the wheel's contact area with the rail, and the resulting friction when the trolley is moved in the track.

Figure 7:
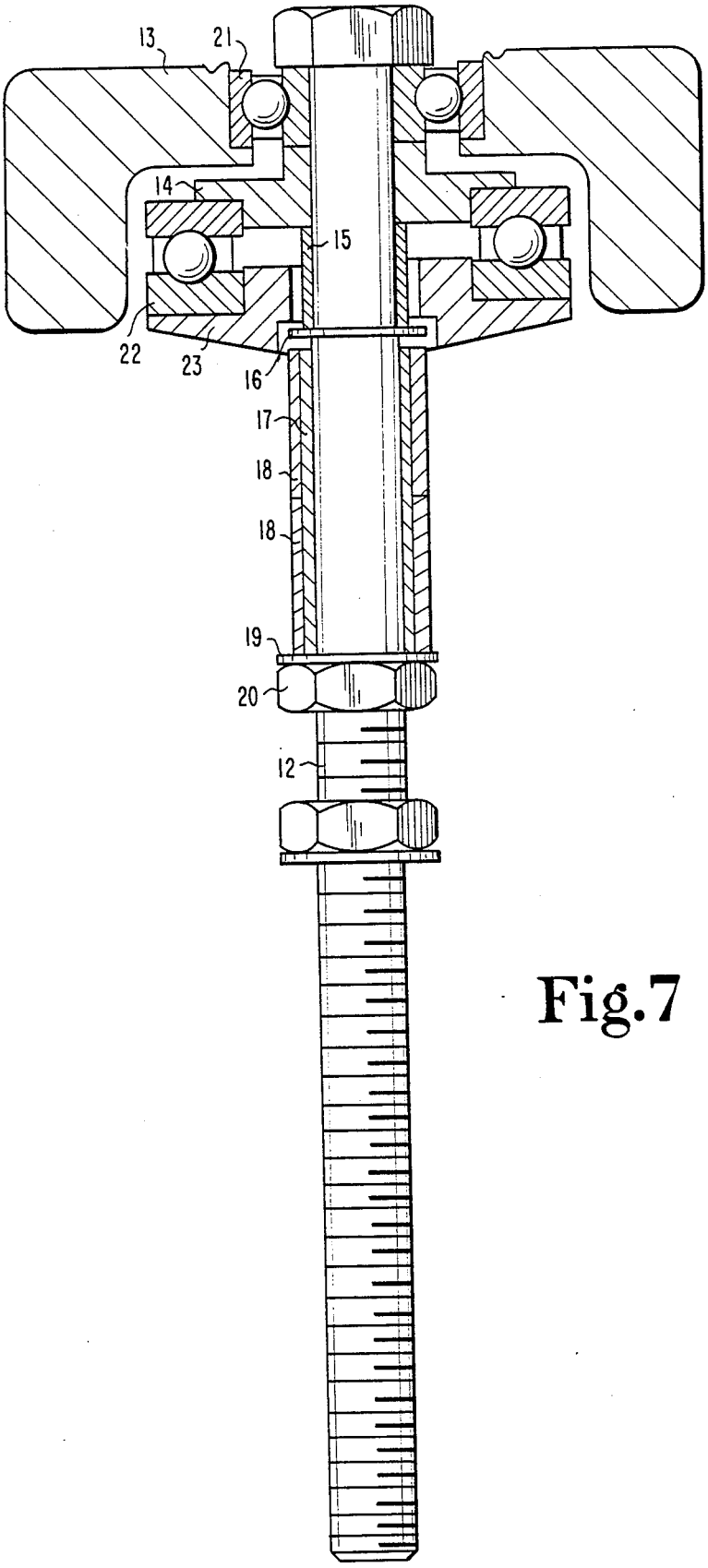
FIG. 7 is a section of the trolley of the invention.

FIG. 7 is a section of the trolley of the invention. Pendant bolt 12 serves as a mounting shaft for outer drive wheel bearing 21, bottom spacer 14, and upper spacer tube 15. Outer drive wheel 13 is fitted to outer drive wheel bearing 21 to be rotatable with respect to bolt 12. The construction of outer drive wheel 13 creates a cavity in which bottom spacer 14 is fitted to inner drive wheel bearing 22, which supports inner drive wheel 23, allowing said wheel to rotate independently of both bolt 12 and outer drive wheel 13. Outer drive wheel bearing 21, bottom spacer 14, and upper spacer tube 15 are upwardly fitted against the top of bolt 12 by washer 16, which in turn is supported by lower spacer tube 17, which is secured by lock washer 19 and jam nut 20. Sleeve bearings 18 are placed around lower spacer tube 17, and are freely rotatable thereon. The plane defined by the lower surface of said outer drive wheel 13 is immediately adjacent to the outermost surface of said inner drive wheel 23.

Figure 8:
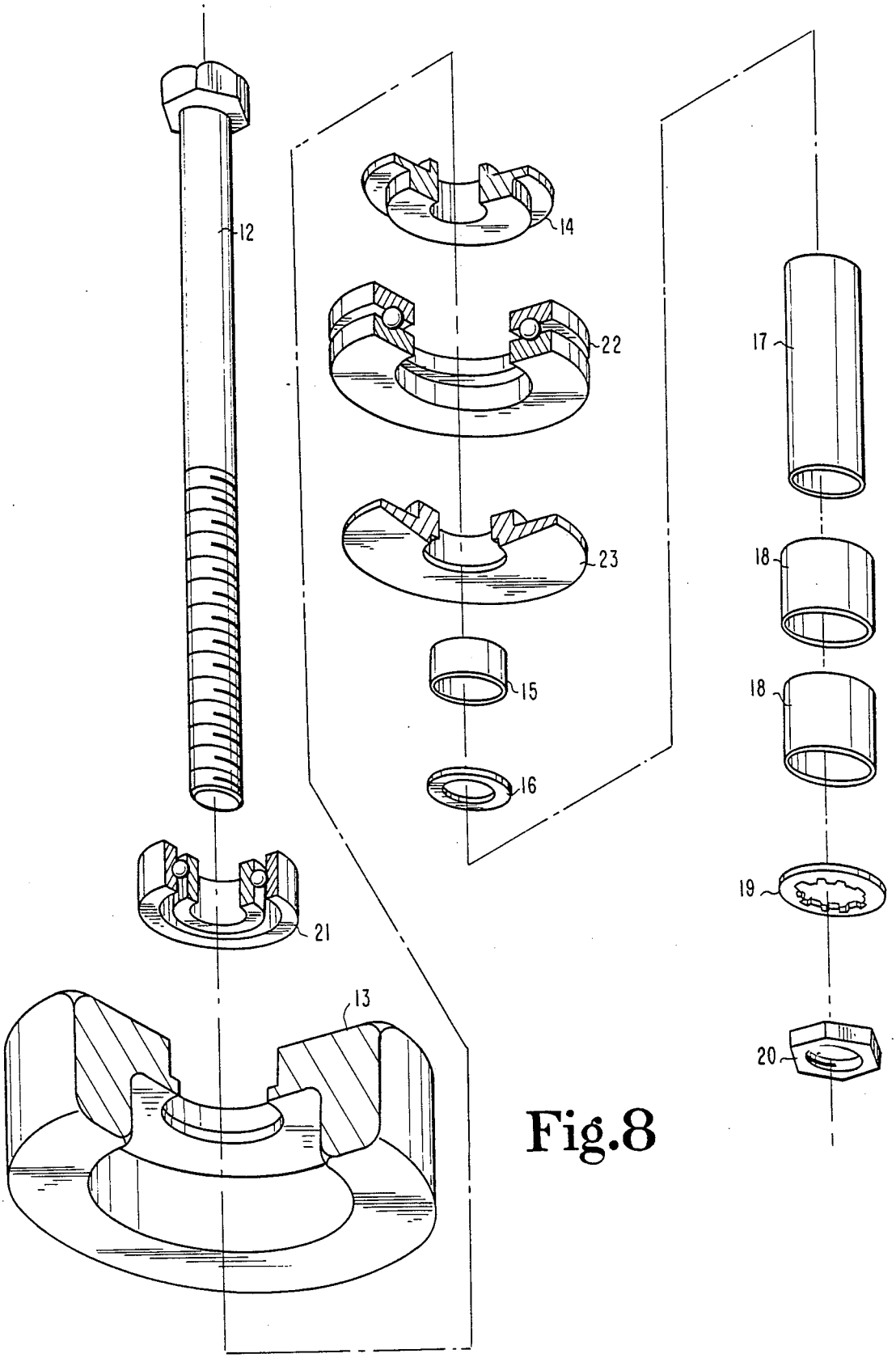
FIG. 8 is an exploded partial section of the trolley of the invention.

FIG. 8 is an exploded partial section of the trolley of the invention, whereby the construction thereof as described above may be more fully appreciated.

Figure 9:
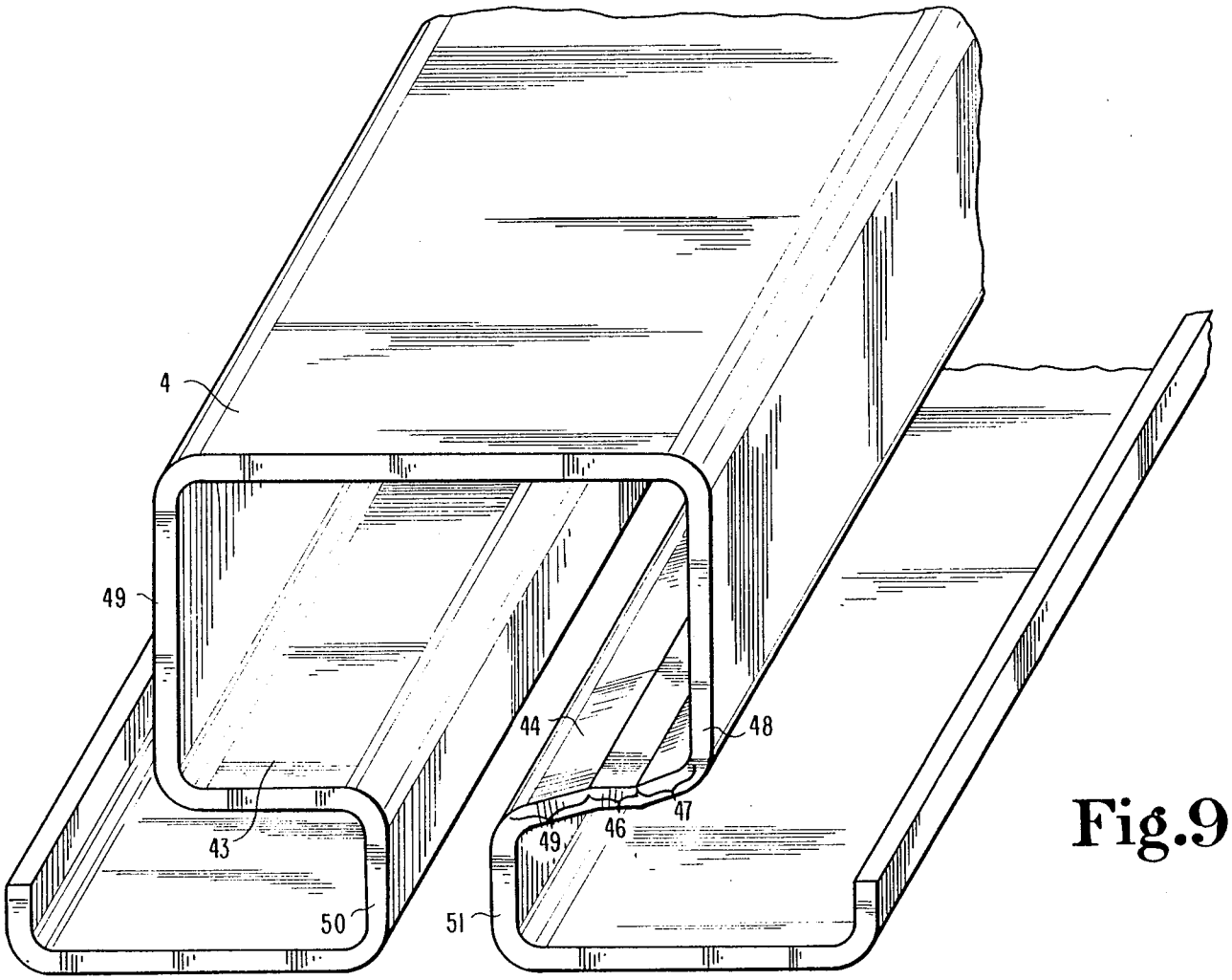
FIG. 9 is a perspective view of the track of the invention.

FIG. 9 is a perspective view of the track of the invention. Track 4 may be integrally formed from commercial quality hot rolled steel or extruded aluminum, and shaped using techniques well-known in the art and which do not form a part of the present invention. Track 4 includes left rail 43, right rail 44, left wall 49, right wall 99, left guide wall 50 and right guide wall 51. Left rail 43 has a horizontal planar surface. In the preferred embodiment as shown in FIG. 9, right rail 44 includes three separate longitudinal planar surfaces, 45, 46, and 47. Planar surface 46 is coplanar with the left rail surface 43. Planar surface 45 angularly extends below planar surface 46, while adjacent planar surface 47 angularly extends upwardly from planar surface 46. However, it is also possible to construct right rail 44 so it has no surface coplanar with left rail 43, and the entire right rail 44 merely angles downwardly from right wall 99. Right rail 44 may either terminate after the trolley engaging surface, or continue to right guide wall 51. Although such a construction would allow the trolley to engage the track as shown in FIGS. 2 and 6, such a construction would not be capable of accommodating a wheeled trolley as shown below in FIG. 11, because right rail 44 would not contain a surface coplanar with left rail 43. Alternatively, planar surfaces 45 and 47 could be constructed to form adjacent "steps" to planar surface 46, the only requirement being that planar surface 45 be below planar surface 46, and planar surface 46 be below planar surface 47.

Figure 10:
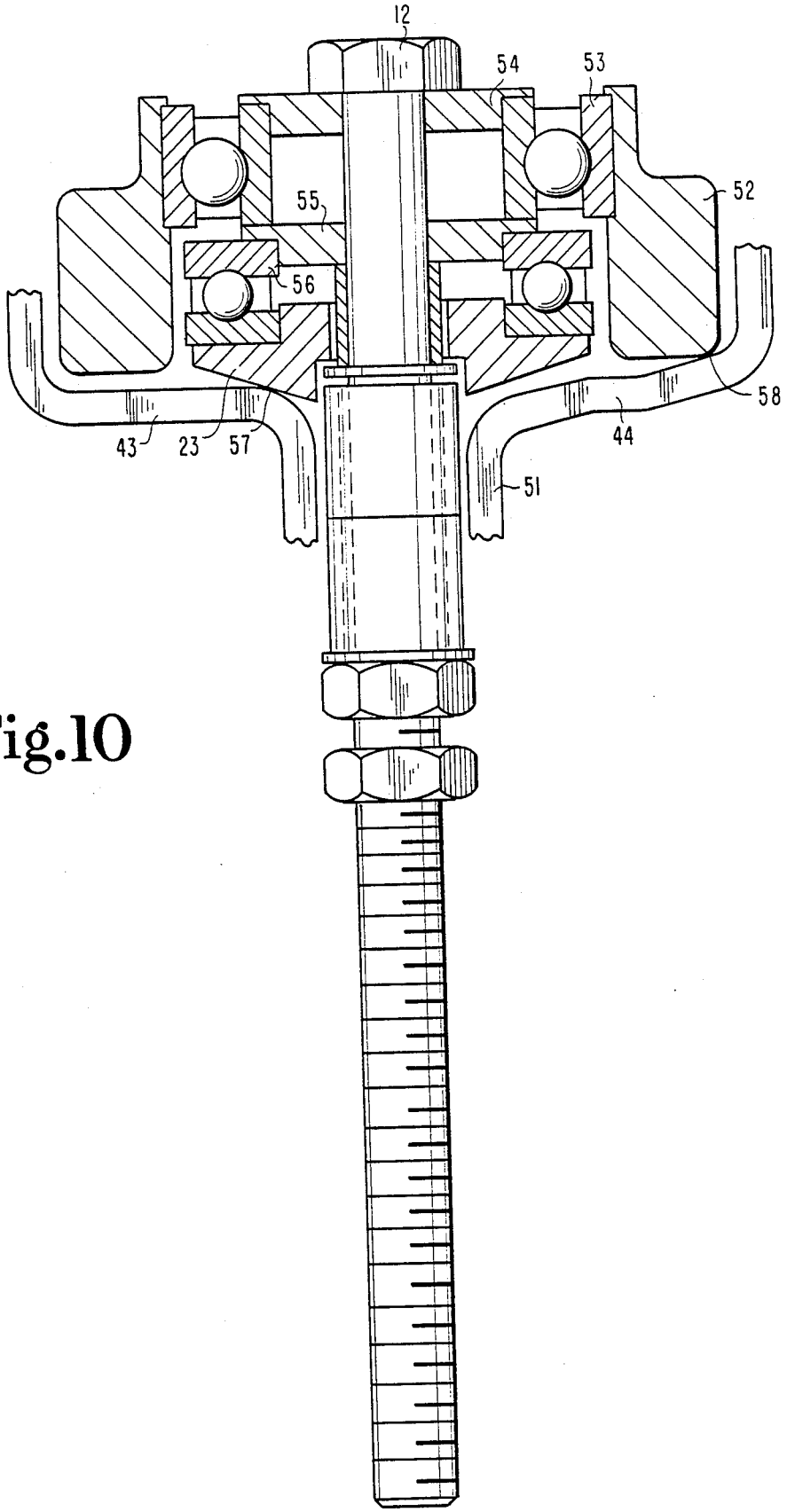
FIG. 10 is a vertical section of the trolley of the invention, showing an alternate bearing and outer drive wheel configuration.

FIG. 10 is a vertical section of the trolley of the invention, showing an alternate bearing and outer drive wheel configuration. Specifically, to support heavier wall panels, outer drive wheel 52 is supported by a larger outer drive wheel bearing 53, which in turn is secured to bolt 12 by both upper spacer 54 and lower spacer 55. Lower spacer 55 also supports inner drive wheel bearing 56. It may also be appreciated from FIG. 10 that the contact point 57 between inner drive wheel 23 and left rail 43 is 180 degrees apart from contact point 58 of outer drive wheel 52 and right rail 44, thus keeping the trolley level within the track. In addition, it is apparent that as the trolley travels through the track, inner drive wheel 23 will rotate in a direction counter to that of outer drive wheel 52.

It may further be appreciated that because outer drive wheel 52 does not contact right rail 44 between contact point 58 and right guide wall 51, this portion of right rail 44 need not necessarily be triplanar as described above. All that is necessary to practice the invention is that right rail 44 have some longitudinal surface that is above the surface of left rail 43, so that the respective surfaces may be independently engaged by the inner and outer drive wheels. However, such a construction would not prove suitable for a wheeled dolley as shown in FIG. 11.

Figure 11:
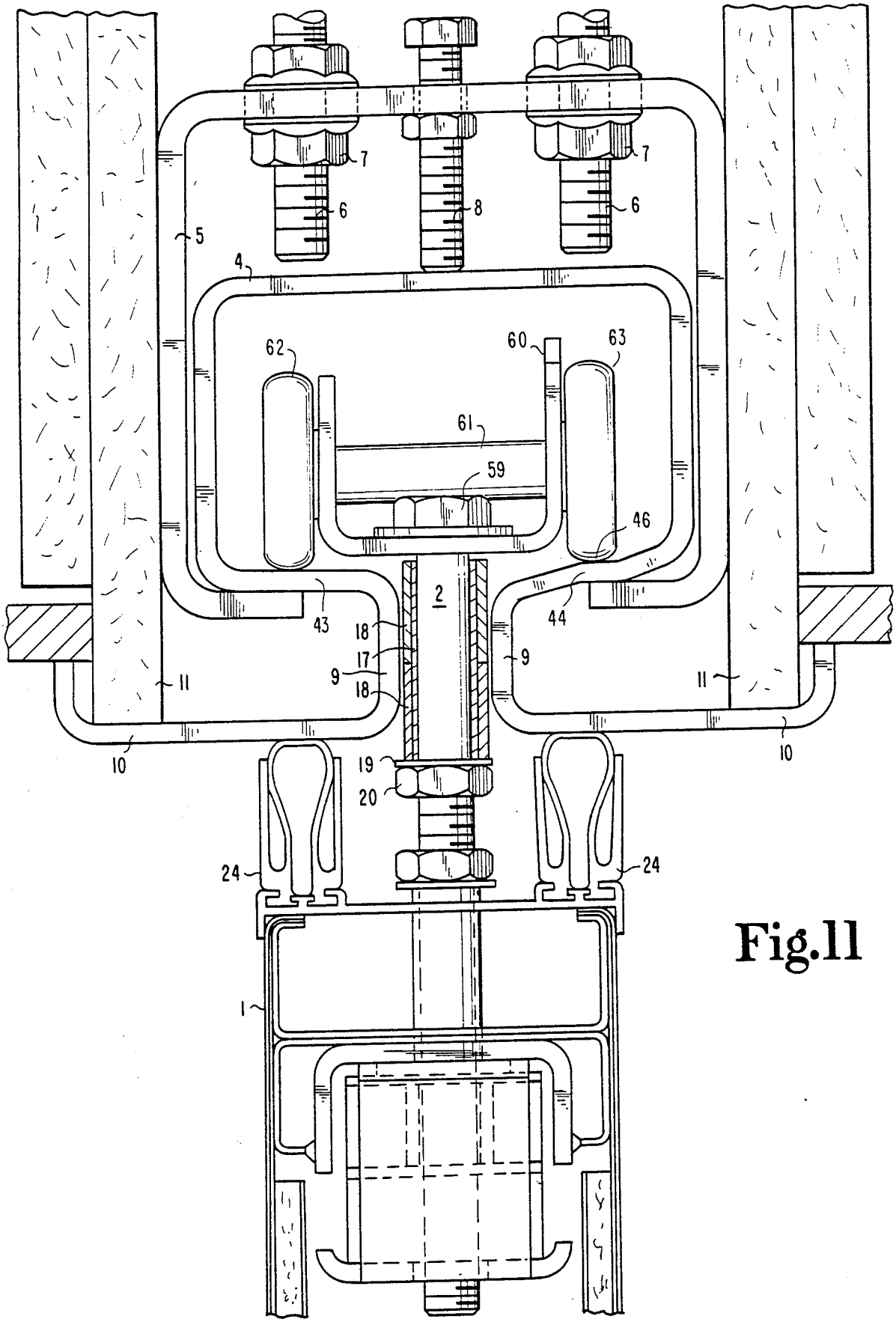
FIG. 11 is a vertical section of the track of the invention, showing how it may be used with a conventional wheeled dolley.

In FIG. 11, the track as described above is shown using a wheeled dolley of the type well known in the art. Thus, the advantage of the present invention may be appreciated because the track may be used not only with a trolley having inner and outer drive wheels as described above, but also with such wheeled dolleys. Specifically, bolt 59 is secured to shaft support 60. Support 60 supports shaft 61, on which wheels 62 and 63 are mounted. Wheel 62 engages left rail 43, while right wheel 63 engages the horizontal longitudinal planar portion 46 of right rail 44, which is coplanar with left rail 43.

Figure 12:
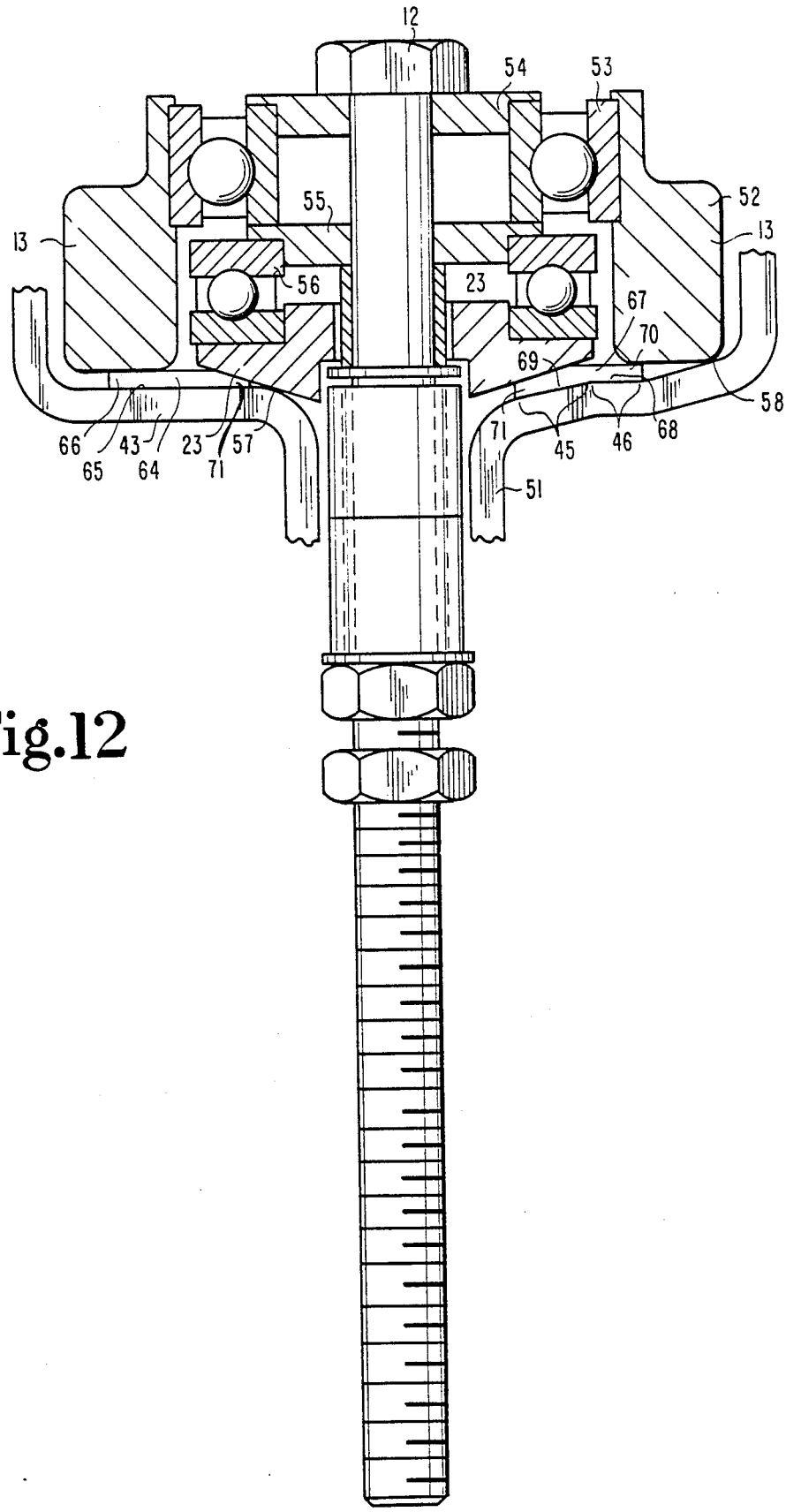
FIG. 12 is a vertical section of a track intersection of the invention, showing the slide pads which reduce both friction and the vertical elevational drop in such intersections.

FIG. 12 is a vertical section of a track intersection of the invention, showing the slide pads 64 and 67 which reduce the vertical elevational drop in such intersections. The slide pads reduce vertical elevational drop of the trolleys in intersections by supporting the lower surfaces of the inner and outer drive wheels across an intersection before the center of the trolley crosses the intersection. Thus, when a trolley is in the middle of an intersection, it is fully supported by the slide pads, instead of dropping and being supported by the rails themselves. Left rail slide pad 64 has a flat lower surface 65, to accommodate the horizontal surface of left rail 43. The upper outer surface 66 of the pad is also horizontal, and supports outer drive wheel 13. The upper inner surface 71 is tapered, and adapted to support inner drive wheel 23.

Right rail slide pad 67 has inner and outer portions. The lower outer surface 68 is horizontal, and is capable of fitting against the horizontal portion 46 of right rail 44. The lower inner portion 69 is tapered at the same angle as the planar surface 45 of right rail 44. The upper outer surface 70 of the pad is horizontal and engages outer drive wheel 13. The inner upper surface 71 of the pad is angled at the same angle as inner drive wheel 23 to engage the same. Thus, when a trolley is moved into a track intersection, the slide pads occupy the vertical gaps between each drive wheel and the track, providing additional support for the trolley. Although the slide pads have been described with respect to the particular upper track surfaces and lower drive wheel surfaces described above, the invention only requires that the slide pads occupy sufficient space between such surfaces to support the drive wheels in a track intersection.

It may thus be appreciated that both sides of the inner and outer drive wheels are engaged by the slide pad when the trolley is moved into a track intersection. This has the shortcoming noted above of the the opposite sides of each drive wheel rotating in a direction counter to the direction the panel is being moved, thus creating additional friction. Therefore, it is preferable for the slide pads to be made of a hard, low-friction material such as powdered metal, nylon or molydisulfide oil-impregnated nylon.

Figure 13:
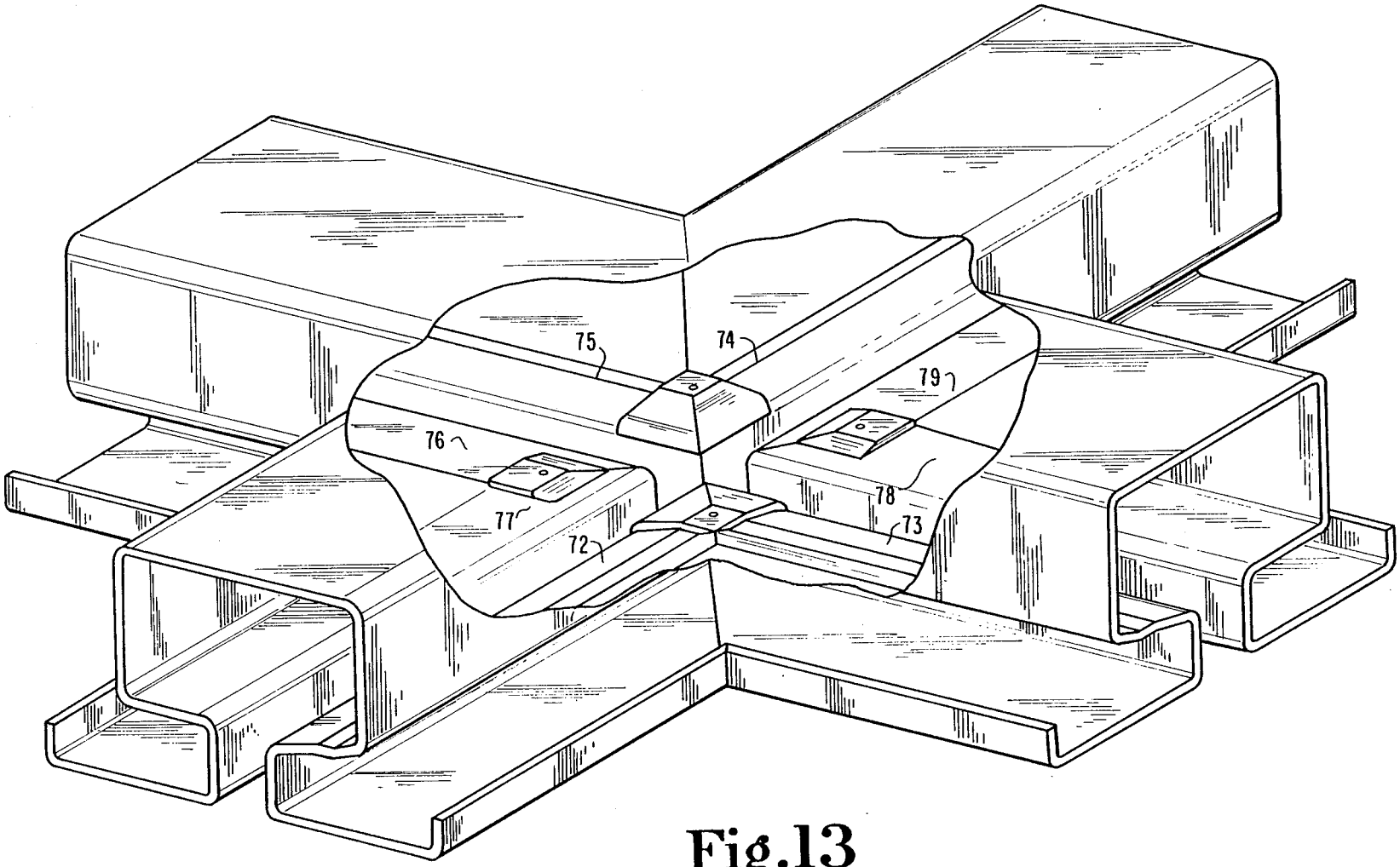
FIG. 13 is a cut-away prespective view of the slide pads of the invention mounted in a track X intersection.

FIG. 13 is a cut-away perspective view of the slide pads of the invention mounted in a track X intersection. It may be appreciated that in such track intersections, multiplanar rails 72, 73, 74 and 76 (referred to as the right rail above) are joined only with other multi-planar rails, while horizontal rails 76, 77, 78 and 79 (referred to as the left rail above) are joined only with other horizontal rails. As described above, the slide pads are shaped differently depending on whether they are mounted on a multi-planar rail or a horizontal rail. The slide pads may be square in shape, and are usually symmetrical with respect to their diagonal extending towards the center of the intersection when rails of identical shape are joined.

Figure 14:
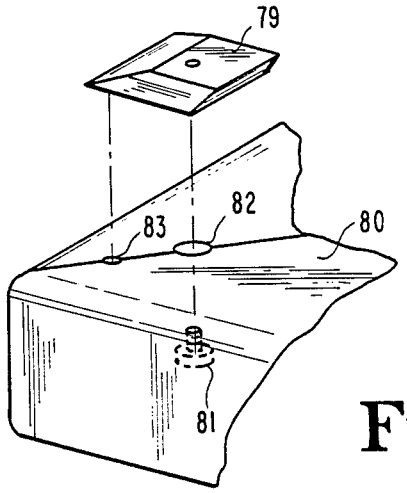
FIG. 14 is a perspective view showing how a slide pad may be fastened to the track of the invention.

FIG. 14 is a perspective view showing how a slide pad may be fastened to the track of the invention. Slide pad 98 may be secured to track intersection 80 by screw 81. The screw is placed through screw hole 82 drilled through track 80. Rotation of slide pad 79 around screw hole 82 may be prevented by placing lug (not shown) on the slide pad into a second hole 83 drilled through track 80.

Figure 15:
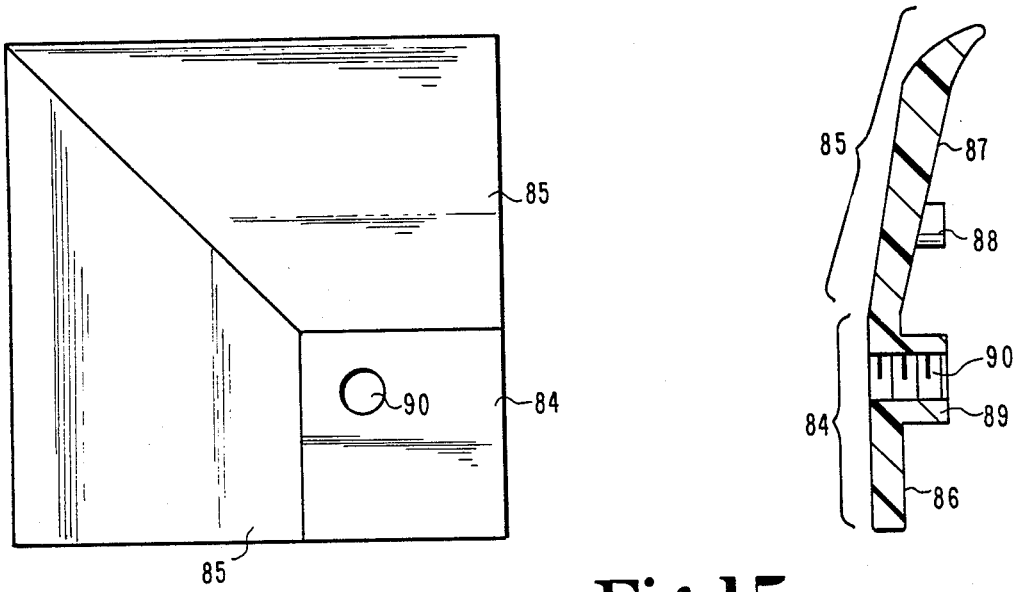
FIG. 15 is a detail of a slide pad of the invention for use on track corners where horizontal rails intersect.

FIG. 15 is a detail of a slide pad of the invention for use on track corners where slanted rails intersect. The upper surface includes a horizontal portion 84 for engaging the outer drive wheel, and a slanted portion 85 for engaging the inner drive wheel. The lower surface also has a horizontal surface 86 to fit the horizontal planar portion of the rail, and a slanted surface 87 to fit the inner slanted surface of the rail. The pad also includes hole 90, which is capable of receiving a screw or other fastener to secure the pad to the track. Screw receiving wall 89 and lug 88 also serve to prevent the lug from moving on the track.

Figure 16:
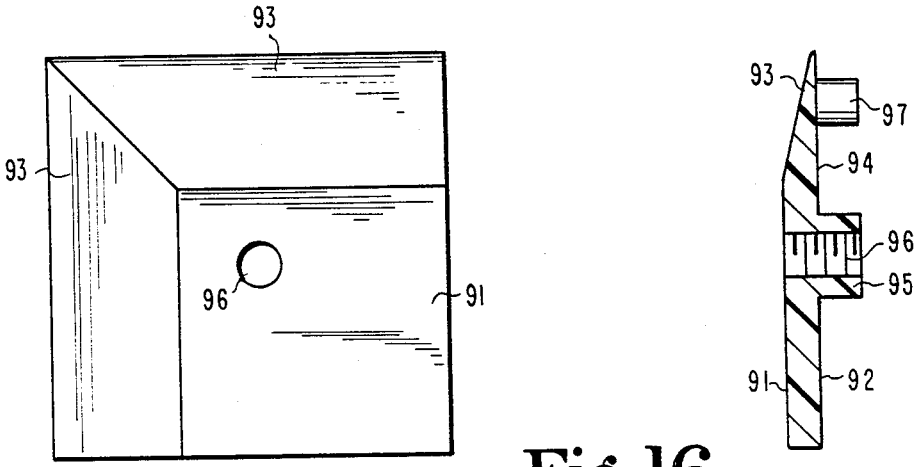
FIG. 16 is a detail of a slide pad of the invention for use on track corners where slanted rails intersect.

FIG. 16 is a detail of a slide pad of the invention for use on track corners where horizontal rails intersect. The entire lower surface 92 and 94 of the pad is horizontal. Upper surface portion 91 is also horizontal to provide support of the outer drive wheel, while upper surface portion 93 is slanted to support the slanted inner drive wheel. The pad also includes hole 96, which is capable of receiving a screw or other fastener to secure the pad to the track. Screw receiving wall 95 and lug 97 also serve to prevent the lug from moving on the track.

Although the present invention has been described with reference to the accompanying drawings, it is not limited to that precise embodiment, and various changes and modifications can be effected therein without departing from the scope or spirit of the invention.

We claim:

1. A track capable of receiving both dolleys and disc trolleys, comprising:

first and second longitudinally parallel rails;

said rails being unsymmetrical;

said second rail having first and second longitudinal planar surfaces disposed in a horizontally adjacent relationship;

said first longitudinal planar surface being coplanar with an upper surface of said first rail;

said second longitudinal planar surface being higher than said first longitudinal planar surface.

2. The track of claim 1, wherein said first rail has a horizontal longitudinal surface.

3. The track of claim 1, wherein said first and second rails are enclosed in a common housing.

4. The track of claim 1, further comprising bottom surfaces of said first and second rails wherein said bottom surfaces are substantially coplanar to allow said track to be mounted in a C channel.

5. The track of claim 1, wherein said first and second rails are integrally formed.

6. The track of claim 1, further comprising:

parallel guide walls extending downwardly from said first rail and from the first longitudinal planar surface of said second rail.

7. The track of claim 6, further comprising flanges extending outwardly from said guide walls, said flanges being capable of receiving a wallboard.

8. The track of claim 1, wherein the first rail and the first longitudinal planar surface of the second rail are capable of receiving a wheeled dolley.

9. The track of claim 1, further comprising means for mounting said track in an overhead structure.

10. A track capable of receiving disc trolleys, comprising:

first and second longitudinally parallel rails each rail consisting of integrally formed upper and lower surfaces, said rails being unsymmetrical;

said upper surface of said first rail having a longitudinal lineal surface;

said upper surface of said second rail having a longitudinal lineal surface higher than said upper surface of said first rail;

and such that the lower surfaces of said rails are substantially coplanar to allow said track to be mounted in a C channel.

11. The track of claim 10 wherein said first and second rails are integrally formed.

12. The track of claim 10 wherein said first rail has a horizontal longitudinal surface.

13. The track of claim 10, wherein said first and second rails are enclosed in a common housing.

14. The track of claim 10, further comprising parallel guide walls extending downwardly from said first and second rails.

15. The track of claim 14, further comprising flanges extending outwardly from said guide walls, said flanges being capable of receiving a wallboard.

16. The track of claim 10, further comprising means for mounting said track along an overhead structure.

17. A trolley comprising:
a vertical shaft;
an outer drive wheel having a lower annular track engaging surface;
said outer drive wheel being rotatably mounted on said shaft;
an inner drive wheel having a lower annular track engaging surface of a diameter less than the diameter of the annular track engaging surface of said outer drive wheel;
said inner drive wheel being rotatably mounted on said shaft;
wherein the annular track engaging surface of said inner drive wheel is below the annular track engaging surface of said outer drive wheel; and
wherein said inner drive wheel and said outer drive wheel may be independently rotated in opposite directions.

18. The trolley of claim 17 wherein said inner drive wheel has a substantially tapered lower surface whereby the annular surface of said inner drive wheel closest to said shaft is below the annular surface of said inner drive wheel furthest from said shaft.

19. The trolley of claim 18 wherein the surface of said inner drive wheel is conical in shape.

20. The trolley of claim 18 wherein the surface of said inner drive wheel is spherically formed.

21. The trolley of claim 19 wherein the plane defined by the lower surface of said outer drive wheel is immediately adjacent to the outermost surface of said inner drive wheel.

22. The trolley of claim 17 wherein the lower surface of said inner drive wheel is horizontal.

23. The trolley of claim 17 wherein the lower surface of said outer drive wheel is horizontal.

24. The trolley of claim 17, further comprising:
a cavity within said outer drive wheel; and
mounting means located within said cavity for mounting said inner drive wheel on said shaft.

25. The trolley of claim 17, further comprising means on said trolley for coupling a panel thereto.

26. A wall panel mount assembly comprising: a housing integral with a movable wall panel,
said housing having upper and lower walls and an upper aperture capable of receiving a shaft, said housing enclosing:
a nut having internal threads capable of receiving a threaded shaft;
a first resilient flexible block surrounding said nut;
a first washer horizontally positioned above said flexible block and in contact with the upper wall of said housing;
a second washer horizontally positioned below said flexible block;
a second resilient flexible block of material below said second washer and contacting the bottom wall of said housing, and having a cavity capable of receiving a shaft.

27. The assembly of claim 26, further comprising a third washer having a diameter greater than said first washer, positioned between said first washer and said first resilient flexible block.

28. The assembly of claim 26, further comprising an aperture in the bottom wall of said housing of a diameter greater than the diameter of the shaft which may be received by said nut.

29. A track and trolley system, comprising:
first and second longitudinal parallel rails;
said second rail having first and second longitudinal planar surfaces;
said first longitudinal planar surface being coplanar with the surface of said first rail;
said second longitudinal planar surface being higher than said first longitudinal planar surface;
a trolley comprising,
a vertical shaft;
an outer drive wheel having a lower annular track engaging surface capable of engaging the second longitudinal surface of said second rail;
said outer drive wheel being rotatably mounted on said shaft;
an inner drive wheel having a lower annular track engaging diameter less than the diameter of the annular track engaging surface of said outer drive wheel and being capable of engaging said first rail;
said inner drive wheel being rotatably mounted on said shaft;
wherein the innermost annular track engaging surface of said inner drive wheel is below the annular track engaging surface of said outer drive wheel;
wherein said inner drive wheel and said outer drive wheel may be independently rotated in opposite directions.

30. The system of claim 29, wherein:
said first rail has a horizontal longitudinal surface,
said first and second rails are enclosed in a common housing, and
said first and second rails are integrally formed.

31. The system of claim 29, further comprising bottom surfaces of said first and second rails wherein said bottom surfaces are substantially coplanar to allow said track to be mounted in a C channel.

32. The system of claim 29, further comprising:
parallel guide walls extending downwardly from said first rail and from the first longitudinal planar surface of said second rail.

33. The system of claim 29 wherein:
said inner drive wheel has a substantially tapered lower surface whereby the annular surface of said inner drive wheel closest to said shaft is below the annular surface of said inner drive wheel furthest from said shaft, and
wherein the lower surface of said outer drive wheel is horizontal.

34. The system of claim 29, further comprising:
a cavity within said outer drive wheel; and
mounting means located within said cavity for mounting said inner drive wheel on said shaft.

35. The system of claim 29, further comprising means on said trolley for coupling a panel thereto.

36. A track and trolley system, comprising:
first and second longitudinal parallel rails having upper and lower surfaces;

said first rail having a longitudinal lineal upper surface;

said second rail having a longitudinal lineal surface higher than the surface of said first rail;

and such that the lower surfaces of said rails are substantially coplanar to allow said track to be mounted in a C channel;

a trolley comprising, a vertical shaft;

an outer drive wheel having a lower annular track engaging surface capable of engaging the longitudinal linear surface of said second rail;

said outer drive wheel being rotatably mounted on said shaft;

an inner drive wheel having a lower annular track engaging diameter less than the diameter of the annular track engaging surface of said outer drive wheel and being capable of engaging said first rail;

said inner drive wheel being rotatably mounted on said shaft;

wherein the innermost annular track engaging surface of said inner drive wheel is below the annular track engaging surface of said outer drive wheel;

wherein said inner drive wheel and said outer drive wheel may be independently rotated in opposite directions.

37. The system of claim 36, wherein:

said first rail has a horizontal longitudinal surface, said first and second rails are enclosed in a common housing, and said first and second rails are integrally formed.

38. The system of claim 36, further comprising:

parallel guide walls extending downwardly from said first rail and from the first longitudinal planar surface of said second rail.

39. The system of claim 36 wherein:

said inner drive wheel has a substantially tapered lower surface whereby the annular surface of said inner drive wheel closest to said shaft is below the annular surface of said inner drive wheel furthest from said shaft, and wherein the lower surface of said outer drive wheel is horizontal.

40. The system of claim 36, further comprising:

a cavity within said outer drive wheel; and mounting means located within said cavity for mounting said inner drive wheel on said shaft.

41. The system of claim 36, further comprising means on said trolley for coupling a panel thereto.

42. A track intersection, trolley and slide pad system, comprising:

a trolley comprising, a vertical shaft;

a first drive wheel rotatably mounted on said shaft;

a second drive wheel rotatably mounted on said shaft;

at least two track sections, each comprised of first and second parallel rails, wherein when said trolley is placed between said rails, said first drive wheel rotatably engages said first rail but leaves a vertical gap between it and said second rail, and said second drive wheel rotatably engages said second rail but leaves a vertical gap between it and said first rail;

said track sections being disposed in angular relation to each other to form a gap between at least one rail of said track sections;

means on said track intersections for attachment of slide pads to the rails of said track;

slide pads attached to each track intersection where rails are angularly joined;

said slide pads being comprised of a low-friction material;

wherein, each slide pad occupies the vertical space between the rails on which it is mounted and the drive wheel not engaged by said rail to engage and support said drive wheel.

43. The system of claim 42, wherein:

said first and second drive wheels engage said first rail and second rails, respectively, via annular engaging surfaces, and wherein, the first annular engaging surface is wider in diameter that the second annular engaging surface.

44. The system of claim 43, wherein:

said first drive wheel has a flat lower surface such that there is a vertical space between said drive wheel and a longitudinal portion of at least one of the rails when the trolley is mounted in said track.

45. The system of claim 43 wherein the radius of the annular engaging surface of said first drive wheel is equal to or greater than the diameter of the annular engaging surface of said second drive wheel.

46. The system of claim 45 wherein said first drive wheel has a horizontal lower surface.

47. The system of claim 42 wherein said slide pads are comprised of steel.

48. The system of claim 42 wherein said slide pads are comprised of nylon.

49. The system of claim 42 wherein said slide pads are comprised of molydisulfide oil-impregnated nylon.

* * * * *